United States Patent [19]

Hipkins, Sr. et al.

[11] Patent Number: 4,704,053

[45] Date of Patent: Nov. 3, 1987

[54] VERSATILE ROOF BOLT ASSEMBLY

[75] Inventors: Edward C. Hipkins, Sr., Oakdale; Frank M. Locotos, Bridgeville, both of Pa.

[73] Assignees: H & S Machine & Supply Co., Inc., Coroapolis; F. M. Locotos Co., Inc., Pittsburgh, both of Pa.

[21] Appl. No.: 825,248

[22] Filed: Feb. 3, 1986

[51] Int. Cl.[4] ..... E21D 20/02

[52] U.S. Cl. ..... 405/261; 405/259

[58] Field of Search ..... 405/259, 260, 261, 262; 411/427; 403/343

[56] References Cited

U.S. PATENT DOCUMENTS

| | | | |
|---|---|---|---|
| 3,188,815 | 6/1965 | Schuermann et al. | 405/261 |
| 3,973,409 | 8/1976 | Asayama | 405/262 |
| 4,194,858 | 3/1980 | Evans | 405/259 |
| 4,224,971 | 9/1980 | Müller et al. | 405/261 |
| 4,295,760 | 10/1981 | Warner | 405/259 |
| 4,295,761 | 10/1981 | Hansen | 405/259 |
| 4,303,354 | 12/1981 | McDowell, Jr. | 405/261 |
| 4,305,687 | 12/1981 | Parker | 405/260 |
| 4,349,299 | 9/1982 | Eny | 405/261 |
| 4,395,859 | 8/1983 | Rohrer | 405/260 |
| 4,437,795 | 3/1984 | White | 405/261 X |
| 4,477,209 | 10/1984 | Hipkins, Jr. et al. | 405/261 |
| 4,484,833 | 11/1984 | Gallagher, Jr. | 403/343 |
| 4,502,818 | 3/1985 | Elders | 405/259 |
| 4,516,886 | 5/1985 | Wright | 405/261 |
| 4,534,679 | 8/1985 | White et al. | 405/261 |
| 4,556,350 | 12/1985 | Bernhardt et al. | 405/260 |
| 4,595,315 | 6/1986 | Gallagher, Jr. | 405/261 |

FOREIGN PATENT DOCUMENTS

| | | | |
|---|---|---|---|
| 1285081 | 1/1962 | France | 405/261 |

*Primary Examiner*—Dennis L. Taylor

*Attorney, Agent, or Firm*—Webb, Burden, Robinson & Webb

[57] ABSTRACT

The anchor bolt assembly is of the type used in mine roofs and the like in which the anchor bolt assembly is positioned in a bore hole of a rock formation. The bolt assembly includes an elongated shaft having a frusto-conical shaped plug at the upper end of the shaft and a head on the lower end of the shaft. A quick-setting resin cartridge is positioned in the bore hole above the plug of the bolt shaft and the bolt assembly is secured to the rock formation by at least the resin. The anchor assembly includes a helical coil external of, surrounding and connected to the bolt shaft for mixing the resin and urging it upward toward the plug end while the bolt shaft is rotated in one continuous direction. The helical coil is disposed below the conical plug and extends a substantial length along the bolt shaft to achieve the mixing.

13 Claims, 8 Drawing Figures

VERSATILE ROOF BOLT ASSEMBLY

BACKGROUND OF THE INVENTION

1. Field of the Invention

This invention relates to roof bolts and, more particularly, to roof bolts which are positioned in a bore hole drilled in a rock formation in a mine roof and which are held in place within the bore hole by a quick-setting resin system, either alone or in combination with a mechanical anchor.

2. Description of the Prior Art

It is a well established practice in underground mining work, such as coal mining, tunnel excavation or the like, to reinforce or support the roof of the mine to prevent rock falls or cave-ins. The most common means presently used to support a mine roof is an elongated bolt or bar which is inserted into the rock formation above the mine roof in a bore hole and which is securely fixed in the bore hole by an anchoring means such as a mechanical anchor, a quick-setting resin which surrounds the end of the bolt within the hole, or both. The roof bolt, often placed under tension, is used to hold a metal support plate in close engagement with the roof.

The mechanical anchor type of roof bolt is well known and has been used for many years in supporting mine roofs. Such roof bolts typically include an elongated bolt which has a head on one end and is threaded on the opposite end. A radially expanding gripping member, referred to as an expansion shell or gripper, and an internally threaded tapered nut or spreader are placed onto the threaded end of the bolt and the downward movement of the gripper is limited by a stop mechanism such as a nut or the like. The threaded end of the bolt, along with the gripper and spreader, is placed within the bore hole drilled in the rock formation until the gripping surface on the exterior of the gripper makes contact with the rock formation. The bolt is then rotated and because the gripper is constrained from rotating, the spreader is gradually drawn downward into the gripper to cause radial expansion thereof into tightly engaged contact with the wall of the bore hole.

The use of a mechanical anchor type of roof bolt has several disadvantages. Firstly, the strength of such a roof bolt is limited due to the nature of the anchorage and will typically only hold a tension of about 12,000–16,000 lbs. In addition, it is known that the holding power of the mechanical anchor releases over time due to creep, deterioration of the rock formation surrounding the expanded gripper, and the like. This causes the gripper to slip and the tension on the bolt decreases, thereby reducing the roof support.

A more recent and generally more acceptable development has been the use of a quick-setting resin type of bolting system. The use of the term "resin" is meant to include any of the resin systems, adhesive systems, cementitious systems, grouting systems and the like which are known and used in the art. Anchor bolt assemblies relying solely on a resin to mount the roof bolt within a bore hole generally include a length of reinforcing rod, also known as rebar, and an elongated bolt threadedly joined together by a standard coupling. A capsule or series of capsules containing a quick-setting resin system, such as a polyester resin and a catalyst hardener, is positioned at the blind end of the drill hole and the anchor bolt assembly is inserted into the bore hole with the rebar end adjacent the resin capsules. The anchor bolt is then further inserted and rotated so as to rupture the capsules and mix together the resin and catalyst within the bore hole. The resin system components are mixed by the knurled or textured outer surface of the rebar and the mixture quickly sets and securely bonds the rebar to the rock formation. Another type of coupling can be used to allow subsequent tensioning of a resin bolting system. A stop means is provided in the coupling and limits axial advancement of the bolt into the coupling and ensures that initially the entire anchor bolt rotates. After the resin has cured, further turning of the bolt releases or breaks the stop mechanism in the coupling and permits the bolt alone to be rotated and to move upwardly within the bore hole while the remainder of the anchor bolt remains rigid. Sufficient torque can be applied to tension the belt within the bore hole.

Resin based anchor bolt systems are much stronger than conventional mechanical anchor bolts. The resin penetrates into the surrounding rock formation to unite the rock strata and to firmly hold the belt in position in the bore hole. The resin also fills the space between the rock formation and the bolt along a substantial portion of its length. Such a bolt starts to fail at the yield strength of the elongated bolt rod and is typically torqued to a tension of up to about one-half the yield strength.

However, typical resin based anchor bolt systems have several disadvantages. The use of a processed rebar to make contact with the resin results in a device which is much more expensive than conventional mechanical type roof bolts. Furthermore, an additional time factor is added to the installation of such roof bolts since an operator must wait until the resin is solidly cured before the bolt can be tensioned within the bore hole. The use of a textured rebar also does not sufficiently mix the resin components together.

It is accordingly, an object of the present invention to provide a resin based roof bolt which provides positive and complete mixing of the resin components by an additional mixing mechanism.

A roof bolt that includes an apparatus for mixing the resin components is shown in co-pending and commonly owned application Ser. No. 688,038, now U.S. Pat. No. 4,655,645 filed Dec. 31, 1984. This roof bolt provides a mechanical expansion anchor at the end of the bolt shaft adjacent the resin cartridge and a helical coil surrounding and spaced from the bolt shaft and extending along the bolt shaft below the expansion anchor. This arrangement provides excellent mixing. However, the resin flows completely around the expansion anchor and may cause slippage, thus preventing the expansion anchor from making the needed frictional engagement with the bore hole. In addition, the roof bolt does not always adequately rupture the resin cartridge. Further, standard delays are encountered during installation while the resin sets.

It is a further object of the present invention to provide a resin based roof bolt which is versatile and can be used in many different arrangements, yet still provide thorough mixing of the resin components. It is an object to do this in a roof bolt in which the resin does not interfere with the function of a mechanical anchor. It is yet another object to provide such a roof bolt which more completely ruptures the resin cartridge and begins to mix the resin components upon rupture of the cartridge. It is an object to do this with a roof bolt which is reasonably inexpensive and easy to manufacture. It is further an object to provide a roof bolt which is easy and quick to install and which substantially reduces any chance for installation error.

SUMMARY OF THE INVENTION

Accordingly, we have invented an anchor bolt assembly of the type used in mine roofs and the like in which the anchor bolt assembly is positioned in a bore hole of a rock formation. The bolt assembly includes an elongated bolt shaft with an upper end and with a head on a lower end, and a quick-setting resin cartridge is positioned in the bore hole above the upper end of the bolt shaft. The anchor bolt assembly is secured to the rock formation by at least the quick-setting resin. An entrant plug, preferably frustoconical shaped, is provided at the upper end of the bolt shaft and this plug is adapted to rupture the resin cartridge. An elongated helical coil may be provided external of, surrounding and connected to the bolt shaft for mixing the quick-setting resin and urging the quick-setting resin upwardly toward the upper end of the bolt shaft while the bolt shaft is rotated in one continuous direction. The helical coil is disposed below the entrant plug and extends a substantial length along the bolt shaft to achieve the mixing.

The elongated bolt shaft is preferably formed on an upper bolt section and a separate lower bolt section joined together in a unitary structure by a coupler means. The plug is mounted to the upper end of the upper bolt section and the helical coil surrounds the upper bolt section. The coupler ideally has an upper threaded bore adapted to receive a threaded lower end of the upper bolt section in threaded engagement therewith and has a lower threaded bore for receiving the threaded upper end of the lower bolt section in threaded engagement therewith. In a preferred embodiment each threaded bore is a blind bore which extends into the coupler and toward the other threaded bore, but the threaded bores are separated from each other by a solid bridge member. The coupler may also be a stop mechanism type of coupler in order to provide tensioning capability to the roof bolt assembly. A mechanical expansion anchor may be threaded on the upper end of the lower bolt section and disposed beneath the coupler. Further tensioning capabilities may be provided in the roof bolt assembly by providing threads at the lower end of the lower bolt section and placing a dome nut thereon. In addition, further mixing of the resin components may be provided by including at least one mixing fin on an outer surface of the plug.

The bolt shaft may be formed of an elongated reinforcing bar having a textured outer surface. In this case, it is not necessary to include the helical coil. The lower end of the reinforcing bar may be threaded and include a dome nut threaded thereon.

DETAILED DESCRIPTION OF THE DRAWINGS

Figure 1:
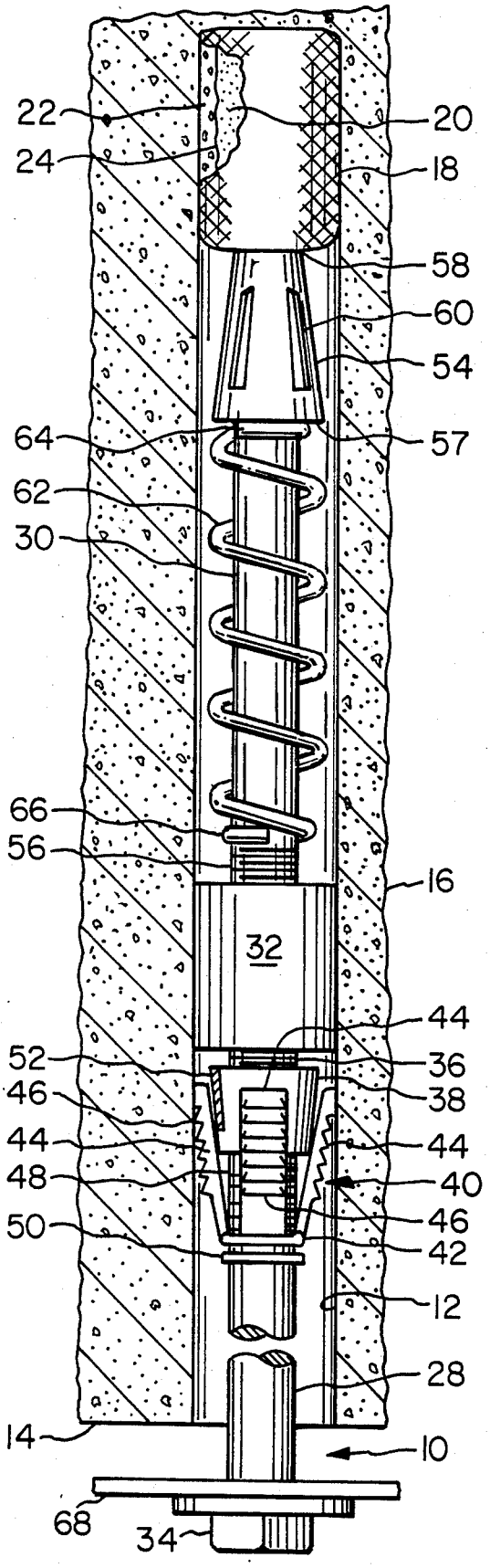
FIG. 1 is a side elevation view, partially in section, showing a rock formation having a bore hole with one embodiment of a roof bolt assembly of the present invention in place just prior to the rupture of a resin cartridge.
Figure 2:
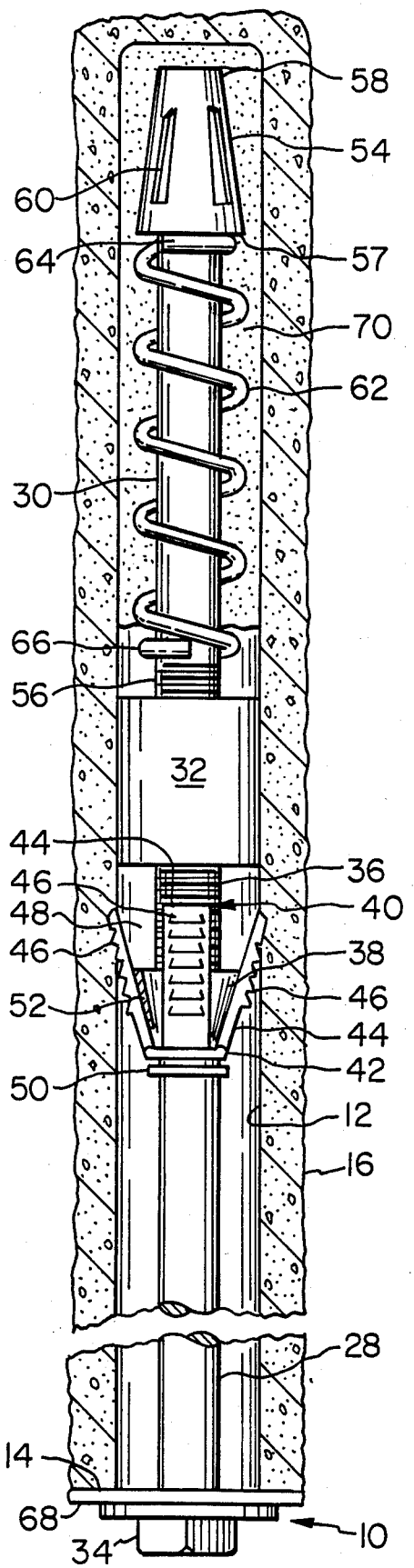
FIG. 2 is a side elevational view similar to FIG. 1 showing the roof bolt assembly as it is finally installed in the bore hole.

Referring now to FIGS. 1 and 2, there is shown a roof bolt assembly, generally designated 10, in accordance with the present invention. The roof bolt 10 is an elongated member often reaching lengths of three to eight feet or longer. The roof bolt 10 is positioned within a bore hole 12 which is drilled upwardly through a generally horizontal mine roof surface 14 and into the rock formation 16 above the mine entry.

A quick-setting resin cartridge 18 is positioned in the blind or upward end of the bore hole 12. The resin cartridge 18 is basically an enclosed, elongated tube which includes two components, an active agent 20 and a reaction agent 22 of a resin grouting mix, separated by a membrane 24. The active agent of a commonly available resin cartridge includes a polyester resin as the major component. The reaction agent is typically a catalyst or curing or hardening agent. The two components 20, 22 of the resin cartridge 18 remain in a semi-liquid or thixotropic phase until mixed, whereupon the resin begins to quickly solidify. Curing and solidification continue until an extremely strong bond is formed by the resin grout. While reference has been made to a "resin" cartridge, it is to be understood that any of the resin systems, adhesive systems, cementitious systems, grouting systems, and the like which are known and used in the art may be used in the present invention and are meant to be encompassed by the term "resin". However, resin cartridges, and in particular, polyester resin cartridges, are preferred for use with the roof bolt assembly 10.

The roof bolt assembly 10 includes an elongated lower bolt section 28 and an elongated upper bolt section 30 rigidly joined together by coupler 32.

The lower bolt section 28 has a head 34 on the one end and has threads 36 at the other end. The threads 36 join the lower bolt section 28 to the coupler 32. The head 34 of a mine roof bolt is typically square rather than hex shaped. An expansion anchor comprising a tapered nut or spreader 38, having therein an internally threaded axial bore, and an expansion shell or gripping member 40, is carried on the threaded end 36 of the lower bolt section 28. The gripping member 40 is formed with a circular collar 42 at its base and with a plurality of radially expandable gripping fingers 44 extending integrally therefrom. Each gripping finger 44 is provided on its external surface with some type of gripping or engagement mechanism such as the plurality of gripping teeth 46 as shown. The gripping fingers 44 are preferably spaced apart from one another by a narrow vertical slot 48. Downward movement of the gripping member 40 is prevented by a stop 50 affixed to the lower bolt section 28 at the bottom of the threads 36 by crimping or by other means as is known in the art. The spreader 38 has a downwardly tapered configuration with an enlarged upper end and a smaller lower end. A portion of the inner surface of each gripping finger 44 abuts the tapered outer surface of the spreader 38. An elongated key 52 on the outer surface of the spreader 38 and integral therewith is positioned within a vertical slot 48 between an adjacent pair of gripping fingers 44 and helps to keep the gripping member 40 from rotating, along with the spreader 38 when the lower bolt section 28 is rotated.

The upper bolt section 30 has a plug 54 on one end and with threads 56 at the other end. The threads 56 join the upper bolt section 30 to the coupler 32. The plug 54 is preferably frustoconically shaped and has a base 57 wider than the upper bolt section 30 but narrower than the bore hole 12. The plug terminates at a narrower top 58. The plug 54 is designed to pierce the resin cartridge 18 and rupture it more completely than the blunt end of a bolt shaft alone. In order to aid in mixing of the resin components 20, 22, the outer surface of the plug 54 may be provided with one or more outwardly directed fins 60.

The roof bolt 10 further includes a separate mechanism connected to the upper bolt section 30 for mixing the two components 20, 22 of the resin cartridge 18 after it has been ruptured. Specifically, there is shown in FIGS. 1 and 2 a helical coil 62 which is separate from and surrounds the upper bolt section 30 and extends downward immediately below the plug 54 in the annulus formed between the rock formation 16 and the upper bolt section 30. The upper end 64 of the helical coil 62 is securely connected to the upper bolt section 30, either directly or by welding the upper end 64 to the base 57 of the plug 54. In a preferred embodiment, the upper end 64 of the helical coil 62 is formed in a loop which surrounds the upper bolt section 30 and is welded to the plug 54. Preferably the lower end 66 of the helical coil 62 terminates in a loop surrounding the upper bolt section 30 as shown. Alternately, the lower end 66 may be affixed securely to the upper bolt section 30 or may hang freely in the annulus between the rock formation 16 and the upper bolt section 30.

The helical coil 62 extends a substantial length along the upper bolt section 30, preferably to threads 56, to achieve the desired mixing. In addition, it is preferred that the helical coil 62 be provided with numerous loops around the upper bolt section 30, with each loop having only a moderate slope. This will further aid in the mixing of the resin components 20, 22.

The operation of roof bolt assembly 10 can be explained with reference to FIGS. 1 and 2. Initially a resin cartridge 18 is placed in the bore hole 12 above the roof bolt 10 and the roof bolt 10 is advanced upwardly into the bore hole 12. FIG. 1 shows the arrangement just prior to the rupture of the resin cartridge 18. The roof bolt 10 then continues to advance into the bore hole 12 and plug 54 on the end of the upper bolt section 30 ruptures the resin cartridge 18. At the same time, the components 20, 22 of the ruptured resin cartridge 18 are forced downward from the upward displacement of the plug 54 anchor assembly.

During installation, the bolt head 34, and, hence, the roof bolt assembly 10, is rotated continuously in one direction and is drawn upward until the support plate 68 located immediately above and in contact with the head 34 comes into contact with the mine roof surface 14. The bolt head 34 typically has a width of about 1⅛ inch while the support plate may be upwards of 6 inches by 6 inches or larger. Continued rotation of the bolt head 34 will then cause the spreader 38 to move downwardly along the threads 36. This downward movement of the spreader 38 causes the gripping fingers 44 to expand radially outward and force the gripping teeth 46 into a secure engagement with the rock formation 16 surrounding the bore hole 12. Rotation of the roof bolt 10 is continued without interruption until the proper tensioning force is reached.

While the roof bolt 10 is being rotated, the fins 60 on plug 54 and the helical coil 62 are simultaneously being rotated. The fins 60 perform an initial mixing of the resin components 20, 22. The resin components 20, 22 are forced downwardly to the vicinity of the helical coil 62 and the action of the rotating helical coil 62 violently mixes the resin components 20, 22 together and continually urges or forces the resin components 20, 22 upwardly. It is thus ensured that the resin components 20, 22 are thoroughly mixed together and completely fill the annulus surrounding the upper portion of the roof bolt 10. The final curing of the resin to its ultimate rigid condition occurs after the rotation of the roof bolt 10 has stopped. At least a portion of the helical coil 62 becomes embedded in the resin thus reinforcing and strengthening the resin. Ideally a substantial portion of the helical coil 62 will be embedded in the resin, but the exact proportion so embedded will depend on the size of the resin cartridge 18, the porosity of the surrounding rock formation 16 and the exact diameter of the bore hole 12 and the upper bolt section 30. The configuration of the roof bolt 10 in place with the cured resin 70 surrounding the upper part of the roof bolt 10 is shown in FIG. 2.

The use of coupler 32 allows the roof bolt assembly 10 to be provided in two shorter components, thus enabling the assembly to be installed in mines having a low ceiling height. The coupler 32 preferably has an outer diameter slightly less than the diameter of the bore hole 12. Coupler 32 keeps the resin from traveling down in contact with the gripping member 40 and causing slippage and possible malfunction of the gripping member 40. The use of gripping member 40 enables the roof bolt 10 to be secured to the bore hole 12 while the resin is curing. Thus the roof bolt 10 can be quickly installed including tensioning and the operator can move on to another bore hole while the resin of the previously installed roof bolt is curing.

The use of the helical coil 62 for continually mixing the resin components 20, 22 provides for a stronger cured resin since it is thoroughly mixed. The fins 60 on the plug 54 also add to a more thorough mixing and aid in locking the smooth bolt into the hardened resin so as to prevent the smooth bolt from turning within the hardened resin when checking torque. Furthermore, strength is added to the assembly because the resin is continually forced upward and reduces the chances of air pockets or gaps forming in the annulus between the upper bolt section 30 and the rock formation 16. Additional strengthening is added by the helical coil 62 being embedded in the cured resin 70. Moreover, this roof bolt assembly 10 is easy to install, requiring only one continuous rotation of the bolt after it has been inserted into the bore hole 12 and it is not necessary to hold the bolt in place or provide external support while the resin is curing.

Figure 3:
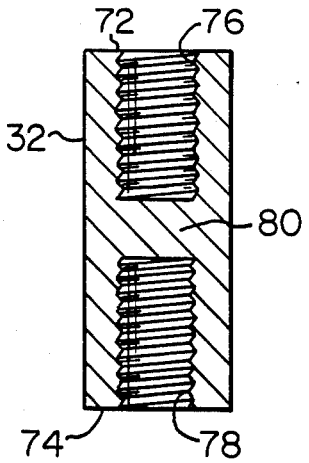
FIG. 3 is a section through the coupler shown in FIGS. 1 and 2.

A preferred coupler 32 is shown in FIG. 3. Coupler 32 is a cylindrically shaped member with an upper surface 72 and a lower surface 74. An upper threaded bore 76 extends into the coupler 32 through upper surface 72 and a lower threaded bore 78 extends into the coupler 32 through lower surface 74. Preferably, the bores 76, 78 are blind bores, in that they extend toward but do not contact each other. Upper bore 76 is separated from lower bore 78 by bridging section 80 and the coupler 32 has an H-shaped cross section as shown in FIG. 3. The use of blind bores 76, 78 is preferred over a single clear through bore to ensure that both the upper bolt section 30 and the lower bolt section 28 are threaded into coupler 32 a sufficient distance to provide for a strong connection. This allows for pre-assembly of the unit and eliminates over or underthreading of either bolt section.

Figure 4:
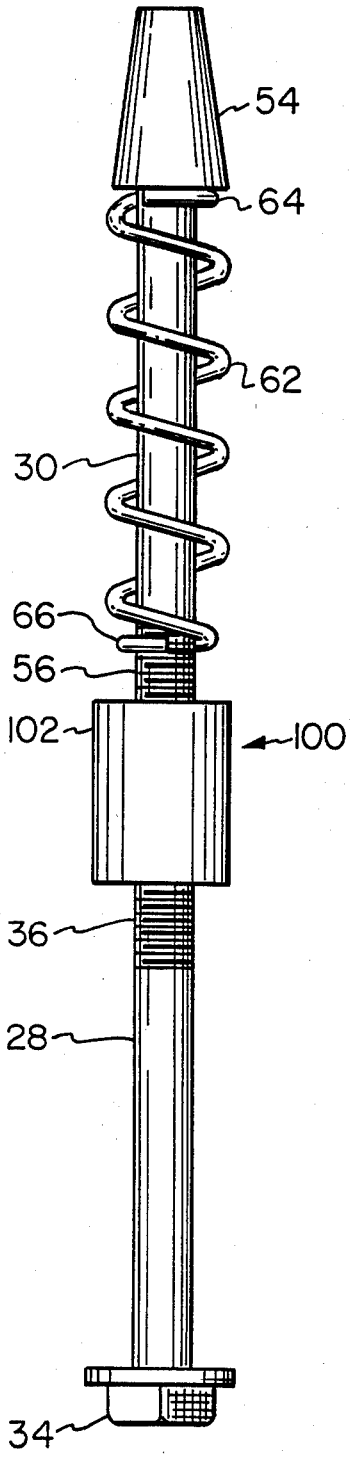
FIG. 4 is a side elevational view of a second embodiment of a roof bolt assembly in accordance with the present invention.

A second embodiment of a roof bolt assembly in accordance with the present invention is shown in FIG. 4 and designated reference number 100. Roof bolt 100 has features similar to roof bolt assembly 10 shown in FIGS. 1 and 2 and like reference numerals will be used to refer to like elements in all Figures.

Roof bolt 100 includes an elongated lower bolt section 28 and an elongated upper bolt section 30 joined together by coupler 102. The lower bolt section 28 has a head 34 on one end and threads 36 at the other end. Unlike the roof bolt 10 shown in FIGS. 1 and 2, lower bolt section 28 in roof bolt 100 does not include a mechanical expansion anchor mounted onto threads 36. The upper bolt section 30 has a plug 54 on one end and has threads 56 at the other end. Fins 60 (not shown) may be included in plug 54 if desired. A helical coil 62 is mounted to, is separate from and surrounds the upper bolt section 30 and extends along upper bolt section 30 below the plug 54 and toward threads 56. The lower bolt section 28 is threadedly connected to coupler 102 by means of threads 36 and the upper bolt section 30 is threadedly connected to coupler 102 by means of threads 56.

Figure 5:
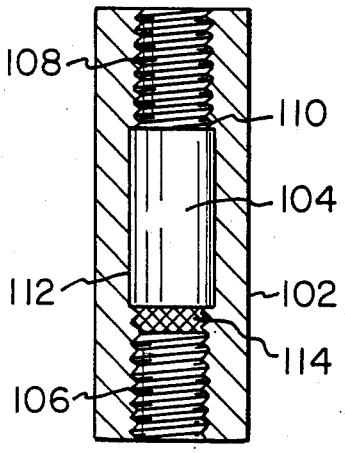
FIG. 5 is a section through the coupler shown in FIG. 4.

The coupler 102, generally referred to as a stop-type coupler mechanism, is shown in more detail in FIG. 5. This coupler is also described in U.S. Pat. No. 4,477,209, commonly owned. The coupler 102 is preferably a cylindrically shaped element which defines an internal bore 104 and includes an internal thread 106 at the lower end of coupler 102 and an internal thread 108 at the upper end of coupler 102. An unthreaded portion 112 is provided intermediate threads 106 and 108 and within the bore 104. A stop 110, such as a shoulder or enlarged thread bottom, is positioned at the internal end of thread 108 to limit the downward movement of the upper bolt section 30. A plug of aluminum 114 is positioned within the bore 104 of coupler 102 and, more particularly, is frictionally engaged by threads 106 at the lower end of coupler 102. Plug 114 is installed in coupler 102 by positioning it in the bore 104 and setting the coupler 102 over a fixed mandrel (not shown) which extends into the lower end of the coupler 102. Thereafter, a punch (not shown) is inserted in the upper end of coupler 102 and is caused to engage plug 114 in a compression mode to extrude the aluminum into threads 106. Since aluminum is appreciably softer than the coupler 102, which is made of steel, the plug 114 easily extrudes in place with the threads 104 acting as the die mold.

The threaded end 36 of the lower bolt section 28 is threaded into engagement with threads 106 of coupler 102 until the lower bolt section 28 engages plug 114 to stop its forward advancement. The upper bolt section 30 is threaded via threads 56 into engagement with threads 108 of coupler 102 and is advanced until it engages stop 110 at the end of threads 108.

The entire roof bolt assembly 100 shown in FIG. 4 is installed by inserting it into a bore hole with a resin cartridge. Since the lower bolt section 28 is in engagement with plug 114 and the upper bolt section 30 is in engagement with the stop 110, rotation of the head 34 of the roof bolt 100 causes the entire assembly to rotate and rupture and mix the resin adhesive in cartridge 18 as discussed above in connection with FIGS. 1 and 2. The resin will be thoroughly mixed by means of the helical coil 62 and the resin will eventually set and harden around the bolt assembly as discussed above. After setting of the resin takes place, additional torquing is supplied to the roof bolt 100 via head 34. Since the upper bolt section 30 is now held rigidly in place by the resin, it can no longer turn and as the lower bolt section 28 advances further into coupling 102, the plug 114 rotates within threads 106 and with the lower bolt section 28 until the plug 114 leaves the threads 106 and enters the unthreaded section 112. Thereafter, no resistance to torquing is encountered as the result of the plug 114. Since the plug 114 actually threads its way out of engagement with the internal threads 106, no galling takes place to the threads and thus rotation of the lower bolt section 28 is not hampered. The head 34 is continued to be rotated until a bearing plate or the like engages the face of the rock formation 14 and the appropriate torque is applied to head 34 with a roof bolting machine or the like.

This second embodiment is a substantial improvement over the roof bolt disclosed in U.S. Pat. No. 4,477,209 referred to hereinabove. A six foot roof bolt made in accordance with that patent weighs on the order of twelve pounds and includes a $\frac{3}{4}$ inch bolt and a length of $\frac{7}{8}$ inch rebar. A comparable roof bolt of this second embodiment is made of two sections of $\frac{3}{4}$ inch bolt and the total weight is on the order of eight pounds. In addition penetration and mixing of the resin is substantially improved.

Figure 7:
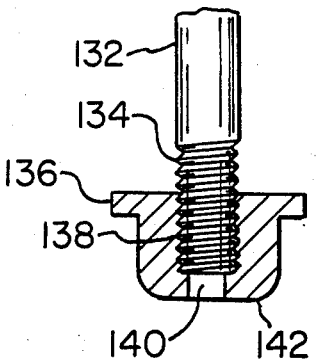
FIG. 7 is a side elevational view, partially in section, of the lower end of the roof bolt shown in FIG. 6.
Figure 6:
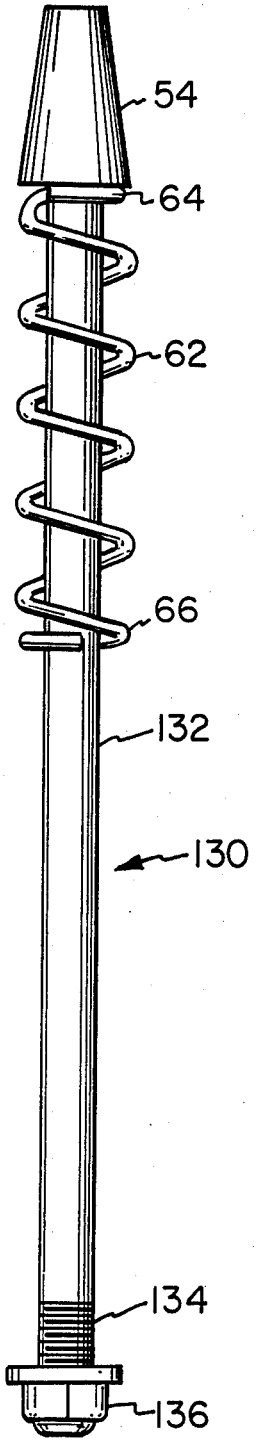
FIG. 6 is a side elevational view of a third embodiment of a roof bolt assembly in accordance with the present invention.

A third embodiment of a roof bolt assembly 130 is shown in FIGS. 6 and 7. Roof bolt assembly 130 includes an elongated bolt shaft 132 having threads 134 at one end and with plug 54 at the other end. Fins 60 (not shown) may be included on plug 54 if desired. A helical coil 62 surrounds and is mounted to the upper portion of the bolt shaft immediately below plug 54 and extends downwardly therefrom along a length of the bolt shaft 132. A dome nut 136 is threadedly mounted onto the lower end of bolt shaft 132 via threads 134. A conventional nut may be employed with fast setting resin systems since the plug 54 and/or the coil 62 provides excellent mixing without the need for torquing.

As shown in FIG. 7, dome nut 136 includes internal threads 138 which are adapted to threadingly mate onto threads 134 of bolt shaft 132. The lower end 142 of dome nut 136 includes a hollow cavity 140 which is adjacent to the lower end of the internal threaded bore 138. The hollow cavity 140 is narrower than the threaded bore 138 and, thus, lower end 142 limits movement of the threaded portion 134 through the threaded bore 138 of the dome nut 136 to prevent the bolt shaft 132 from passing completely through dome nut 136. Lower end 142 is frangible and after the resin sets the bolt 132 can be threaded completely through the dome nut 136. The details of such a dome nut do not form a part of this invention.

As with the other roof bolt assemblies discussed hereinabove, roof bolt assembly 130 is inserted into a bore hole along with one or more resin cartridges. The roof bolt assembly 130 is advanced until the resin cartridge comes in contact with the blind end of the bore hole and, thereafter, plug 54 ruptures and passes through the resin cartridge thus releasing the resin components therein. The entire roof bolt assembly 130 is then rotated via dome nut 136 and the rotation of the helical coil 62 mixes thoroughly the components of the resin cartridge. Since the frangible lower end 142 is in engagement with the threaded end 134 of bolt shaft 132, rotation of the dome nut 136 will initially rotate bolt shaft 132 and the remaining elements of roof bolt 130 rather than cause the dome nut 136 to advance up the threads 134. After setting of the resin takes place, additional torquing is supplied to the roof bolt 130. Since the bolt shaft 132 is now held rigidly in place by the resin, it can no longer turn and as the dome nut 136 is turned it advances and causes downward pressure to be applied from the lower end of the bolt shaft 132 onto the lower end 142. Further rotation of the dome nut 136 will cause the lower end 142 to break thereby removing the impediment to movement of the dome nut up threads 134 of bolt shaft 132. Thereafter, the dome nut 136 is rotated until a bearing plate in contact therewith comes into engagement with the face of the rock formation and the appropriate torque is applied to dome nut 136 with a roof bolting machine or the like to a desired level of stress.

Figure 8:
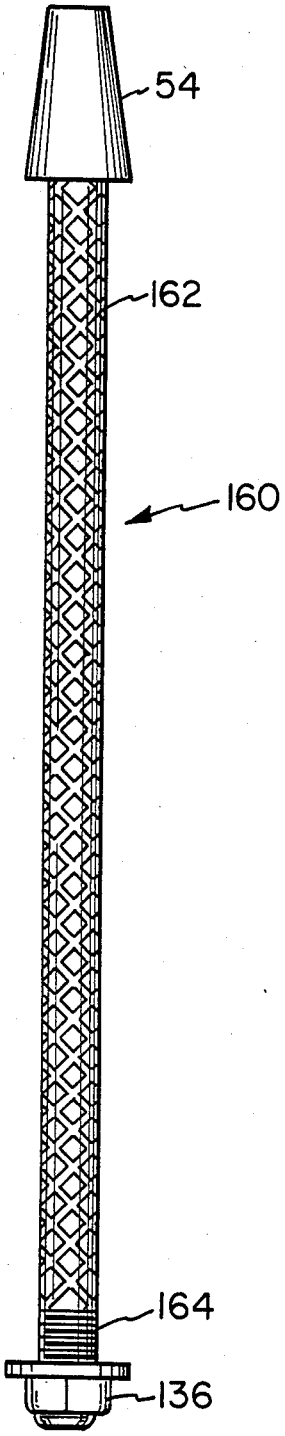
FIG. 8 is a side elevation of a fourth embodiment of a roof bolt assembly in accordance with the present invention.

A fourth embodiment of a roof bolt assembly 160 for use with a resin system is shown in FIG. 8. Roof bolt assembly 160 includes an elongated reinforcing bar 162, rather than a smooth bolt, which terminates at one end in plug 54 and with threads 164 at the other end. Fins 60 (not shown) may be provided on plug 54 if desired. A dome nut 136 is threadedly mounted onto the lower end of reinforcing bar 162 by threads 164. The plug 54 and the embossed or textured outer surface of the reinforcing bar 162 provide sufficient mechanical bonding to adequately retain roof bolt assembly 160 in place.

It can be appreciated by one skilled in the art that the roof bolt assembly 10 shown in FIGS. 1 and 2 cannot be further tensioned once the resin has set. This roof bolt assembly can be modified slightly to provide a tensionable system in one of two ways. In a first modification, coupler 32 shown in FIGS. 1 and 2 can be replaced with the stop-type of coupler, such as coupler 102 shown in FIGS. 4 and 5. Alternatively, the lower end of lower bolt section 28 can be threaded and a dome nut, such as dome nut 136 shown in FIGS. 6 and 7, can be threadedly mounted thereon. Additionally, it is possible, although not necessarily preferable, to remove the gripping member 40 from the roof bolt 10 shown in FIGS. 1 and 2. It is particularly desirable to remove the gripping member 40 if coupler 32 is replaced with a stop-type coupler 102 or head 34 is replaced with a dome nut 136. The roof bolt 100 shown in FIG. 4 can be made non-tensionable by replacing stop coupler 102 with a standard coupler, such as coupler 32 shown in FIGS. 1, 2, and 3. It is also possible to provide the roof bolt assembly 130 shown in FIGS. 6 and 7 in an arrangement which is not tensionable after the resin has set. To this effect, it is possible to merely include a bolt shaft 132 which does not have threads 134 at its lower end and merely provide a head 34 rigidly mounted thereto. Similarly, roof bolt assembly 160 shown in FIG. 8 can be made non-tensionable by eliminating threads 164 and providing a head 34 rigidly mounted to the lower end of reinforcing bar 162.

The plug 54 can be formed on the end of the bolt by a number of different manufacturing techniques such as hot forging or the like. Of course, it will be recognized that plug 54 could be a separate member attached to the bolt shank such as by welding or threading. The shape of plug 54 should be such so as to facilitate rupture and initial mixing of the resin cartridge. In addition, the plug acts as a permanent anchor to retain the bolt in the resin even where a smooth bolt is employed. The enlarged bottom surface 57 of the plug 54 defines an annular shoulder which enhances the tensile strength of the resin bolt assembly. The core shape (actually frustoconical) illustrated has been found excellent for those purposes.

Other than the resin cartridge, the aluminum plug 114 and the frangible disc 142, the various roof bolt assemblies of the present invention will be made entirely of metal such as iron or steel and will start to give at the yield strength of the metal bolt. For example, a $\frac{3}{4}$ inch diameter roof bolt was manufactured from ASTM F432-83, Grade 75 steel and was found to have a yield strength of about 31,000 lbs. A $\frac{5}{8}$ inch diameter roof bolt was manufactured from the same grade of steel and found to have a yield strength of about 21,000 lbs. For a $\frac{5}{8}$ inch diameter bolt it is preferable to form the helical coil from $\frac{1}{8}$ inch diameter wire, while a $\frac{3}{4}$ inch diameter bolt would ideally have a helical col formed from $\frac{1}{4}$ inch diameter wire. It will be recognized that the diameter of the helical coil will vary according to the diameter of the roof bolt and the diameter of the bore hole.

Having described presently the preferred embodiments of this invention, it is to be understood that it may be otherwise embodied within the scope of the following claims.

We claim:

1. In an anchor bolt assembly of the type used in mine roofs and the like in which the anchor bolt assembly is positioned in a bore hole of a rock formation, where the bolt assembly includes an elongated bolt shaft with an upper end and with a head on a lower end, wherein a quick-setting resin cartridge is positioned in the bore hole above the upper end of the bolt shaft, and wherein the anchor bolt assembly is secured to the rock formation by at least the quick-setting resin, the improvement comprising an entrant plug provided at the upper end of the bolt shaft and adapted to rupture the resin cartridge and an elongated helical coil external of and surrounding the bolt shaft and having a direction of coil for mixing the quick-setting resin and urging the quick-setting resin upwardly toward the upper end while the bolt shaft is rotated in one continuous direction, said helical coil disposed below the entrant plug and connected to the entrant plug or the bolt shaft and extending a substantial length along the bolt shaft to achieve the mixing.

2. The improvement of claim 1 wherein said plug is frustoconical shaped.

3. The improvement of claim 1 wherein said plug includes at least one mixing fin on an outer surface thereof.

4. The improvement of claim 1 wherein the lower end of the bolt shaft is threaded and the head is a dome nut threaded thereon.

5. The improvement of claim 1 wherein said elongated bolt shaft is formed of an upper bolt section and a separate lower bolt section joined together in a unitary structure by a coupler means, with said plug mounted to the upper end of said upper bolt section and with the helical coil surrounding the upper bolt section.

6. The improvement of claim 5 wherein the lower end of said upper bolt section is threaded, the upper end of said lower bolt section is threaded, and the coupler means is a member having an upper threaded bore for receiving the lower end of the upper bolt section in threaded engagement therewith and having a lower threaded bore for receiving the upper end of the lower bolt section in threaded engagement therewith.

7. The improvement of claim 6 wherein each said threaded bore is a blind bore which extends into said coupller means and toward the other threaded bore but wherein said threaded bores are separated by a solid bridge member.

8. The improvement of claim 6 wherein said coupler means is a stop mechanism type of coupler.

9. The improvement of claim 6 further including a mechanical expansion anchor threaded on the upper end of the lower bolt section and disposed beneath said coupler means.

10. The improvement of claim 6 wherein the lower end of the lower bolt section is threaded and the head is a dome nut threaded thereon.

11. The improvement of claim 1 wherein an upper end of said helical coil is formed in a loop surrounding the bolt shaft and welded to the plug.

12. The improvement of claim 1 wherein a lower end of said helical coil is one of affixed to the bolt shaft and hanging freely in an annulus between the rock formation and the bolt shaft.

13. A mine roof reinforcement comprising an anchor bolt assembly installed with resin in a bore hole of a rock formation, said bolt assembly comprising a bolt shaft having an entrant plug at an innermost end and a head at an outermost end and external of the bore hole and a helical coil disposed below the entrant plug and external of and surrounding the bolt shaft and embedded in the resin which surrounds the entrant plug and a substantial portion of the bolt shaft, said helical coil extending a substantial length along the bolt shaft and connected to at least one of a bottom of the entrant plug at a top end of said helical coil and to the bolt shaft at a bottom end of said helical coil, said helical coil having mixed said resin and urged said resin upwardly toward an upper end while the bolt shaft was rotated in one continuing direction.

* * * * *